United States Patent [19]

Sherman

[11] 4,167,658

[45] Sep. 11, 1979

[54] SAFETY AND SECURITY OUTLET

[76] Inventor: Robert S. Sherman, 28 McDonnell Dr., Randolph, Mass. 02368

[21] Appl. No.: 890,584

[22] Filed: Mar. 20, 1978

[51] Int. Cl.[2] ..... H01H 9/28; H01H 13/70; H01H 27/10

[52] U.S. Cl. ..... 200/44; 200/51 R

[58] Field of Search.... 200/42 R, 44, 321, 51 R, 51 Rx, 200/50 B, 334; 339/75 R, 75 A; 70/57

[56] References Cited

U.S. PATENT DOCUMENTS

| | | | |
|---|---|---|---|
| 2,846,530 | 8/1958 | Wintriss | 200/51 R X |
| 3,524,029 | 8/1970 | Laff | 200/44 |
| 4,063,110 | 12/1977 | Glick | 200/44 X |

*Primary Examiner*—Steven M. Pollard

*Attorney, Agent, or Firm*—Wolf, Greenfield & Sacks

[57] ABSTRACT

An electrical receptacle lock having a housing carrying a pair of prongs to be mounted in a conventional wall outlet. Openings are provided in the housing to receive the plug prongs of an appliance to be controlled by the lock. One contact in the housing connects one plug prong to a housing prong, and a second contact connects the other prongs. A key operated cam in the housing makes and breaks one of the contacts, and latching means carried by that contact mechanically locks onto the plug prong. The latching means is controlled by a stem mounted in the housing but cannot be operated to unlock the plug prong to enable the plug to be withdrawn unless the key operated cam is positioned to make the contact.

9 Claims, 5 Drawing Figures

SAFETY AND SECURITY OUTLET

INTRODUCTION

This invention relates to appliance locks and more particularly is a new and improved receptacle lock for appliances, which prevents the appliance from being operated from a conventional wall outlet by unauthorized persons.

A variety of locking devices have been developed for preventing the unauthorized use of electrical equipment. These devices conventionally fit over the plug on the power cord and prevent the plug from being mounted in an electrical outlet. One such device is shown in Efston U.S. Pat. No. 3,543,544 dated Dec. 1, 1970. In that device a housing receives the plug prongs, and pivotally mounted pawls in the housing retain the prongs by frictional engagement unless they are released by a combination lock in the housing. When the equipment is to be used, the lock is opened, the device removed from the plug, and the plug is then mounted in the service outlet.

Such prior art devices have certain disadvantages. First, the device must be physically removed from the plug to allow authorized use, and the device may be lost or misplaced. Second, the continued connecting and disconnecting of the plug to the device causes wear of both the plug and the device and each may require repair or replacement. And many such devices are relatively expensive.

One important object of this invention is to provide a lock for electrical appliances such as saws, drills, radios, televisions, etc., which need not be removed from the appliance plug when the appliance is to be used, so that it will not become lost or misplaced.

Another object of this invention is to provide an appliance lock which is relatively inexpensive.

Yet another object of this invention is to provide an appliance lock which enables the appliance to be mechanically plugged into a wall outlet but which may provide a closed circuit from the outlet to the appliance only when turned "on" by a key.

To accomplish these and other objects, this invention includes a housing having prongs that enable the device to be plugged into a conventional service outlet, and also having openings that receive the prongs of the appliance plug. Conducting contacts connect the respective prongs. A latching device is carried by one of the contacts for mechanically engaging one of the plug prongs to lock it in the opening, and a key operated non-metallic cam is mounted in the housing for making and breaking the electrical connection between one of the contacts and the housing prong to close and open the electrical circuit. The latching device may be released by the use of a thin implement inserted in an opening in the housing so as to enable the plug to be removed. However, the latching device may not be released if the cam is in position to open the electrical circuit. Therefore, if the circuit is closed, the appliance may be connected to a power source by merely plugging the device into an electrical outlet. However, if the circuit is open, even with the device plugged into the outlet, the appliance cannot be operated. Moreover, if the circuit is open, unauthorized use may not be gained by by-passing the device because the device can not be removed from the plug.

These and other objects and features of the invention will be better understood and appreciated from the following detailed description of one embodiment thereof shown in the accompanying drawings.

BRIEF FIGURE DESCRIPTION

DETAILED DESCRIPTION

Figure 1:
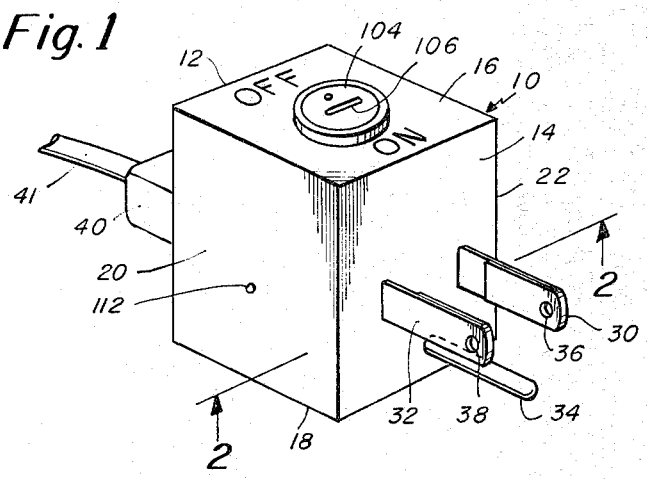
FIG. 1 is a perspective view of an electrical receptacle lock constructed in accordance with this invention and showing the prongs with which the device may be connected to a conventional wall outlet.

The electrical receptacle lock shown in the drawings includes a housing 10 composed of front wall 12, rear wall 14, top wall 16, bottom wall 18 and side walls 20 and 22. The walls of the housing define an irregularly shaped chamber 24 that contains the unique features of the present invention.

Rear wall 14 carries a pair of prongs 30 and 32 and a ground pin 34 adapted to be connected respectively to the plus and minus sides and the ground of a conventional wall outlet. Prongs 30 and 32 and ground pin 34 may be imbedded in the material of the housing, which is electrically nonconductive. Prongs 30 and 32 are shown to include openings 36 and 38, respectively, that may cooperate with detents in the wall outlet to releasably retain the prongs in place when the receptacle is plugged into the outlet.

As shown in the drawing, a standard plug 40 which may be connected by its cord 41 to any appliance to be controlled by the receptacle lock, has a pair of prongs 42 and 44 that are plugged into receptacle openings 46 and 48 formed in the front wall 12 of the housing 10. The prongs 42 and 44, just like the prongs 30 and 32 of the receptacle itself, include openings 50 and 52 commonly employed to releasably retain the prongs in a conventional wall outlet.

The receptacle prong 32 is integrally formed with a contact strip 60 disposed against the inner face 62 of wall 20 of housing 10, and the contact strip extends from prong 32 along wall 20 to the front wall 12 where the strip turns through 180° so as to form a resilient terminal blade 64 oriented to engage the prong of any line plug such as prong 44 of plug 40 inserted into opening 48. The position of the terminal blade 64 is such that it bears firmly against any prong inserted in outlet opening 48 so as to make a good electrical connection between the inserted prong and the contact.

Figure 2:
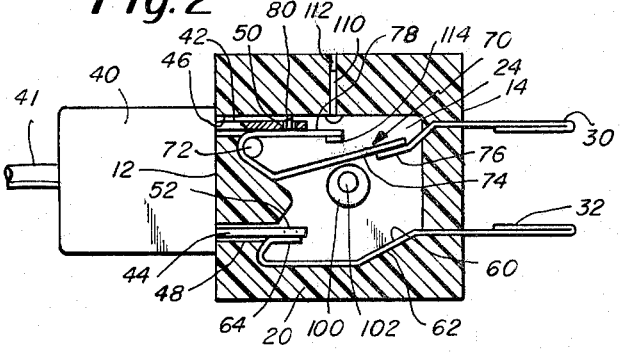
FIG. 2 is a cross-section view taken along the section line 2—2 of FIG. 1 and showing the manner in which a conventional appliance plug is secured to the device, the device itself being in an "on" condition.
Figure 4:
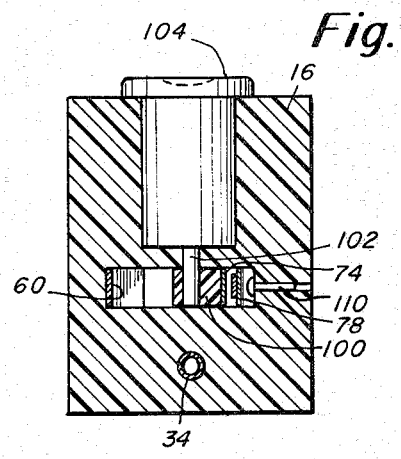
FIG. 4 is a cross-sectional view taken along the section line 4—4 of FIG. 3.

A second contact strip 70 in the form of a spring blade is mounted in chamber 24. Contact strip 70 is wrapped about a post 72 adjacent to the other opening 46 in front wall 12 of the housing. One leg 74 of contact strip 70 is biased to engage the inner end 76 of prong 30 while the other leg 78 of the contact strip essentially parallels one side of opening 46. Leg 78 carries a pin 80 that is positioned to enter the opening 50 in the prong 42 of plug 40 when the prong is inserted in the opening 46 as shown in FIG. 2. Both legs 74 and 78 define flexible contact blades that are designed to be deflected from their positions shown in FIG. 2 so as to break contact with the prong 30 and to remove the pin 80 from the opening 50. These operations are carried out as described below, to perform the intended functions of this recepticle lock. Non-metallic cam 100 is mounted eccentrically on the shaft 102 connected to the key cylinder 104 mounted in the wall 16 of the housing. The cylinder 104 has a key slot 106 to receive the operating key to enable the shaft to be turned through approximately 180° so that cam 100 may be rotated between the position shown in FIG. 2 and that shown in FIG. 3. The lock details including tumblers, etc., which control the operation of the cam and respond to the key do not form part of the present invention as a variety of different locks may be selected. When the cam 100 is in the position shown in FIG. 2, it is disengaged from the blade 74 of contact strip 70, and the normal bias of the blade causes it to engage the inner end 76 of prong 30 so as to provide electrical continuity from prong 30 to blade 78 and place the receptacle lock in the "on" condition. When the cam is rotated approximately 180°, it assumes the position shown in FIG. 3 wherein it lifts the blade 74 out of engagement with the inner end 76 of the prong 30 so as to deactivate the device or turn it "off."

Figure 5:
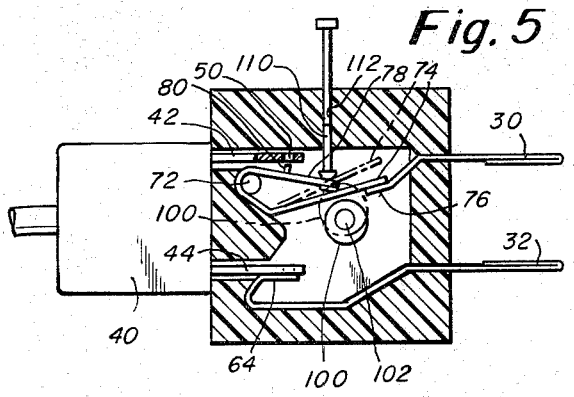
FIG. 5 is a view similar to FIG. 2 but showing how the appliance plug may be removed.

The spring blade 78 is moved by a non-metallic pin 110 disposed in wall 22 and movable axially in its hole 112. The axis of pin 110 is aligned with the end 114 of blade 78 so that when the pin 110 is moved axially as suggested in FIG. 5 it forces the blade 78 to deflect and thereby withdraw the pin 80 from the opening 50 in prong 42. The non-metallic pin 110 may be moved by inserting a small diameter nail or other comparable implement into the opening 112 so that it engages the outer end of the pin and forces the inner end against the end 114 of contact leg 78. It will be appreciated from an inspection of FIG. 5 that the blade 78 cannot be deflected so as to withdraw its pin 80 from the opening in the prong if the blade 74 is displaced to the open position by cam 100. This is suggested in dotted lines in FIG. 5. Therefore, when the receptacle is turned "off", the plug 40 cannot be removed from the device.

Figure 3:
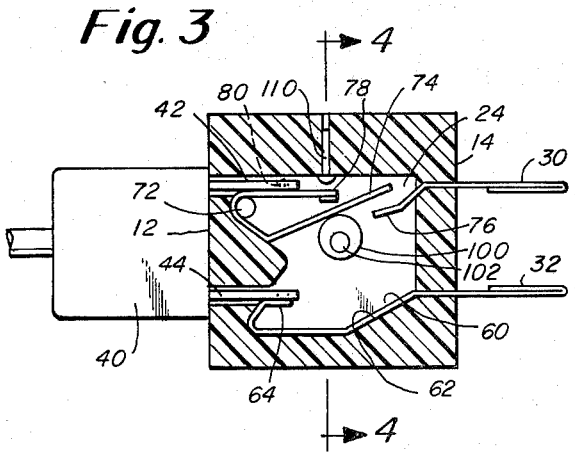
FIG. 3 is a cross-sectional view similar to FIG. 2 but showing the device in an "off" condition.

The use of the device as a receptacle lock to prevent the unauthorized use of an appliance should now be apparent. The plug of the appliance is plugged into the outlet slots 46 and 48 of the housing 10, and the key is used to turn cam 100 to the "off" position as shown in FIG. 3. In that position, the continuity of the receptacle itself is broken and therefor even if the prongs 30 and 32 (and ground 34) are plugged into a wall outlet, no current will flow to the appliance. Neither can the receptacle lock be removed from the plug 40 to enable the appliance to be plugged directly into a wall outlet and by-pass the lock. If the appliance is to be used by an authorized party, it is only necessary that the key be used to unlock the key cylinder 104 so as to turn the receptacle "on," and the receptacle may be plugged into any appropriate wall outlet. If for some reason the plug is to be removed from the receptacle lock, with the device in the "on" condition (but unplugged from the wall outlet) a nail or other instrument is inserted into the hole 112 to cause the stem 110 to deflect the blade 78 so as to withdraw the pin 80 from the hole 50 in prong 42. With the pin removed, the plug may readily be pulled from the lock.

From the foregoing description those skilled in the art will appreciate that the objects of this invention are achieved in a dependable and safe fashion. The device will prevent the unauthorized use of any appliance plugged into it, and yet by simply unlocking the receptacle any appliance plugged into it is rendered operable.

Because modifications may be made of the invention without departing from its spirit, it is not intended that the breadth of the invention be limited to the specific embodiment illustrated and described. Rather, its scope is to be determined by the appended claims and their equivalents.

I claim:

1. An electrical receptacle lock comprising a housing having a chamber therein, a pair of conducting prongs mounted on and extending from a wall of the housing and adapted to be inserted in an electrical outlet, a pair of openings in another wall of the housing for receiving the prongs of a plug, a first electrical contact in the housing electrically connected to one of the prongs mounted on the housing and positioned to be engaged by one of the prongs of the plug mounted in one of said openings, a second electrical contact in the housing capable of engaging connecting and disconnecting to the other of the prongs mounted on the housing for electrical connection and disconnection of said contact and prong and positioned to be engaged by the other of the prongs of the plug in an opening, switching means mounted in the housing for moving the second electrical contact for making and breaking the electrical connection of the second electrical contact with one of its prongs, and latching means associated with one of the contacts for preventing the plug from being withdrawn from the openings in the housing when the switching means is in the breaking condition.

2. An electrical receptacle lock as defined in claim 1 further characterized by said latching means comprising a pin mounted in the housing and adapted to project through an opening in a plug prong to retain the prong in the wall opening of the housing, and means enabling an operator to remove the pin from the opening, said means including a port in a wall of the housing through which an implement extends.

3. An electrical receptacle lock as defined in claim 2 further characterized by said pin being mounted on one of said contacts, and said contact being flexible and biased to a position wherein the pin engages the plug prong and deflectable so that the pin may be moved generally axially out of said opening.

4. An electrical receptacle lock as defined in claim 3 further characterized by said switching means including a cam rotatable in the housing and engaging the second contact, said cam being manually operable from outside the housing, and which when turned in one direction disengages the contact from the prong, and when turned in another direction causes the contact to engage said prong.

5. An electrical receptacle lock as defined in claim 4 further characterized by said cam preventing the pin from being withdrawn from the plug prong opening when the cam disengages the contact from the prong.

6. An electrical receptacle lock as defined in claim 1 further characterized by said switching means including a cam rotatable in the housing and engaging the second contact, said cam being manually operable from outside the housing, and which when turned in one direction disengages the contact from the prong, and when turned in another direction causes the contact to engage said prong.

7. An electrical receptacle lock comprising a housing, a pair of conducting prongs mounted on and extending from a wall of the housing and adapted to be inserted in a conventional electrical outlet, a pair of openings in another wall of the housing for receiving the prongs of a conventional plug, a first electrical contact in the housing electrically connected to one of the prongs mounted on the housing and positioned to be engaged by one of the prongs of the plug mounted in said openings, a second electrical contact in the housing engaging the other of the prongs mounted on the housing and positioned to be engaged by the other of the prongs of the plug, key operated switching means mounted in the housing for making and breaking the engagement of the second electrical contact with one of its prongs, said second electrical contact making and breaking engagement with its prong mounted on the housing, said second contact being biased to engage that prong and movable by said switching means out of engagement therewith, latching means also carried by said second contact for locking the plug prong engaged by said second contact in the housing opening, and means operable only when the second contact is in the biased position engaging the prong mounted on the housing causing the latching means to unlock the plug prong.

8. An electrical receptacle lock as defined in claim 7 further characterized by said second contact being generally U-shaped, said latching means including a pin mounted on one arm of the U and extending away from the other arm of the U to lock onto the plug prong, said other arm of the U being biased away from the one arm and when disengaging its housing prong being deflected toward the one arm, said other arm when deflected preventing the one arm from being deflected so as to cause the pin to release the plug prong.

9. An electrical receptacle lock as defined in claim 8 further characterized by said switching means including a cam in the housing for deflecting the other arm toward the one arm.

* * * * *